US005160085A

United States Patent [19]

Arnold et al.

[11] Patent Number: 5,160,085

[45] Date of Patent: Nov. 3, 1992

[54] RAILROAD SPIKE

[76] Inventors: James W. Arnold; Evelyn J. Arnold, both of P.O. Box 1150, Biggs, Calif. 95917

[21] Appl. No.: 793,559

[22] Filed: Nov. 8, 1991

[51] Int. Cl.[5] ..... E01B 9/04

[52] U.S. Cl. ..... 238/366; 411/922

[58] Field of Search ..... 238/308, 309, 366-376; 411/439, 487, 488, 489, 490, 493, 912, 913, 922, 923

[56] References Cited

U.S. PATENT DOCUMENTS

| | | | |
|---|---|---|---|
| 880,918 | 3/1908 | Reed | 238/369 |
| 1,200,604 | 10/1916 | Giese | 411/922 X |
| 1,210,426 | 1/1917 | Craven | 411/922 X |
| 2,745,308 | 5/1956 | Gisondi | 411/923 X |
| 3,004,715 | 10/1961 | Gadd | 238/366 X |
| 3,356,300 | 12/1967 | Harrel | 238/366 |
| 3,396,624 | 8/1968 | Eriksson et al. | 411/922 X |
| 3,865,307 | 2/1975 | Schiro | 238/375 X |
| 4,203,193 | 5/1980 | Arthur | 238/371 X |
| 4,403,734 | 9/1983 | Gorman | 238/372 |
| 4,797,046 | 1/1989 | Ollivier et al. | 411/922 X |

FOREIGN PATENT DOCUMENTS

| | | | |
|---|---|---|---|
| 584765 | 5/1932 | Fed. Rep. of Germany | 238/373 |
| 1235405 | 5/1959 | France | 238/373 |
| 554613 | 1/1957 | Italy | 238/371 |
| 1333548 | 10/1973 | United Kingdom | 411/493 |

*Primary Examiner*—David A. Bucci
*Assistant Examiner*—Robert S. Katz
*Attorney, Agent, or Firm*—Mark C. Jacobs

[57] ABSTRACT

An improved railroad spike, configured to resemble a conventional U.S. railroad spike as to its head, shank and tip. The improved spike features (1) a keyhole bore which extends between and through the head and top of the spike, and (2) and a pair of angular V-grooves on the shank in communication with the bore.

9 Claims, 2 Drawing Sheets

RAILROAD SPIKE

BACKGROUND OF THE INVENTION

Much has been written about the railroad systems of the U.S.A. and in particular about the uniting of the vast distant parts of the infant country by the transcontinental railroad. While equipment has slowly modernized over the years, little progress has been made in the mode of actual construction of a railroad.

As is known the trackage or track bed comprises a pair of spaced rails usually made of oak in this country due to availability and durability, mounted upon a plurality of aligned spaced cross ties which are spaced on 16" centers here in the U.S.A. and which lay in a ballast bed of crushed rock. Tie plates, often referred to as baseplates are mounted upon the cross ties and these receive the track lengths therein. Since track lengths are of a finite length, they need to be and are joined together by fishplates which may also be referred to as joint bars. Specially shaped spikes having an off center head are used to retain the track within the tie plates. See FIG. 1.

It is these spikes that form the subject matter of this invention. Usually 5 spikes are used on each side of the tie to hold the two rails to that particular tie plate, often abbreviated as "tie". Whereas conventional spikes have a solid shaft and solid head, the improved railroad spike of this invention has a full length bore through the head and shaft thereby yielding a hollow spike.

Conventional spikes tend to split the oak tie upon being driven into the wood. Therefore it is a first object to provide a railroad spike that reduces the tendency of wood to split when the spikes are driven.

It is another object to provide a railroad spike with improved track holding power.

Yet another object is to provide a hollow core spike.

A further object is to provide a spike that is open at the bottom and receives wood into its core during the driving process.

A still further object is to provide a spike in which the wood received in its core can be locked into place by the action of a drift punch.

An additional object is to provide a railroad spike which permits moisture to permeate down into the tie to thereby reduce internal splitting of the wood.

An important object is to provide a railroad spike which requires less effort to drive it into place.

These and other objects of the invention will in part be obvious and will in part appear hereinafter.

The invention accordingly comprises the product possessing the features, properties and the relation of components which are exemplified in the following detailed disclosure and the scope of the application of which will be indicated in the claims.

For a fuller understanding of the nature and objects of the invention reference should be made to the following detailed description taken in conjunction with the accompanying drawings.

SUMMARY OF THE INVENTION

A new hollow core railroad spike with improved holding power, and which has slanted groove(s) on at least one side thereof for binding into the wood of a railroad tie. The unit includes a full length bore and a notched tip.

DESCRIPTION OF THE PREFERRED EMBODIMENT

Figure 1:
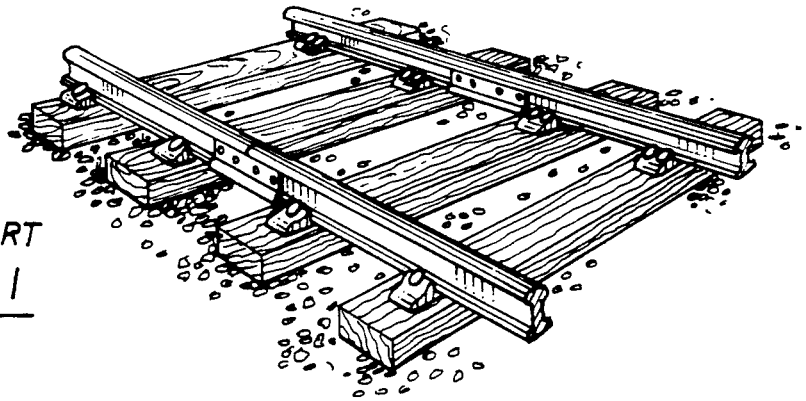
PRIOR ART FIG. 1
FIG. 1 is typical prior art railroad trackage installation as would be seen anywhere in the United States and other countries and which shows the use of traditional railroad spikes.
Figure 9:
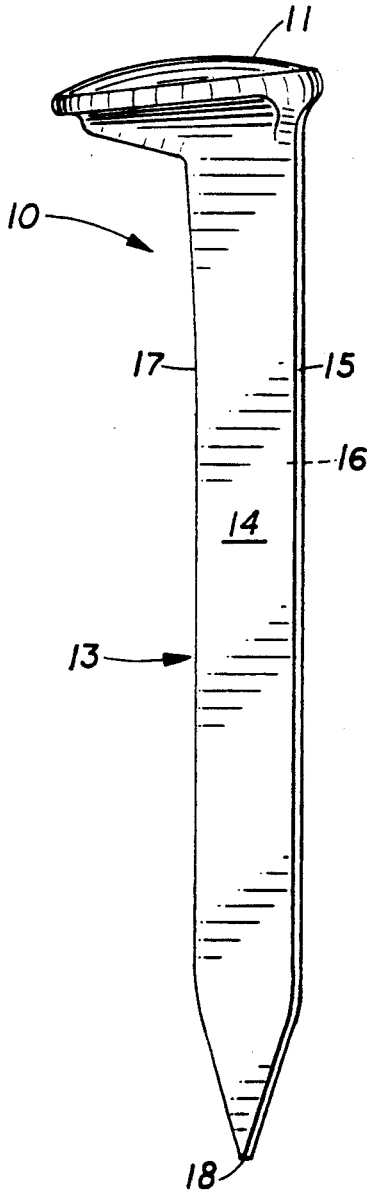
PRIOR ART FIG. 9
FIG. 9 is a perspective view of a prior art spike in use today.

The utilization of railroad spikes is well known. The environment within which they are used has been fully recited above with reference in the introduction to FIG. 1. FIG. 9 is a perspective view of a conventional railroad spike 10, as used by the railroads in the U.S. today. As is seen it has an offset head 11, a generally square shank, 13, the front and rear faces 15, 17 of said shank 13, tapering inwardly to a point 18. The two side faces 14 and 16 are untapered, but they do converge to form the pointed edge 18.

By contrast the spike of this invention is to be seen in FIGS. 2 through 6 inclusive. Spike 30 is dimensionally similar to the prior art spike 10 and as such it can be interchanged for old spike 10 for installations and repairs that are carried out either by hand or by track laying machines.

The spike of this invention has an offset head 31, a generally square shank, 33, the front and rear faces 35, 37 of said shank 33, tapering inwardly to a point. The two side faces 34 and 36 are untapered, but they do converge to form the pointed edge 38.

Figures 2, 3, 4, 5, 6, 7:
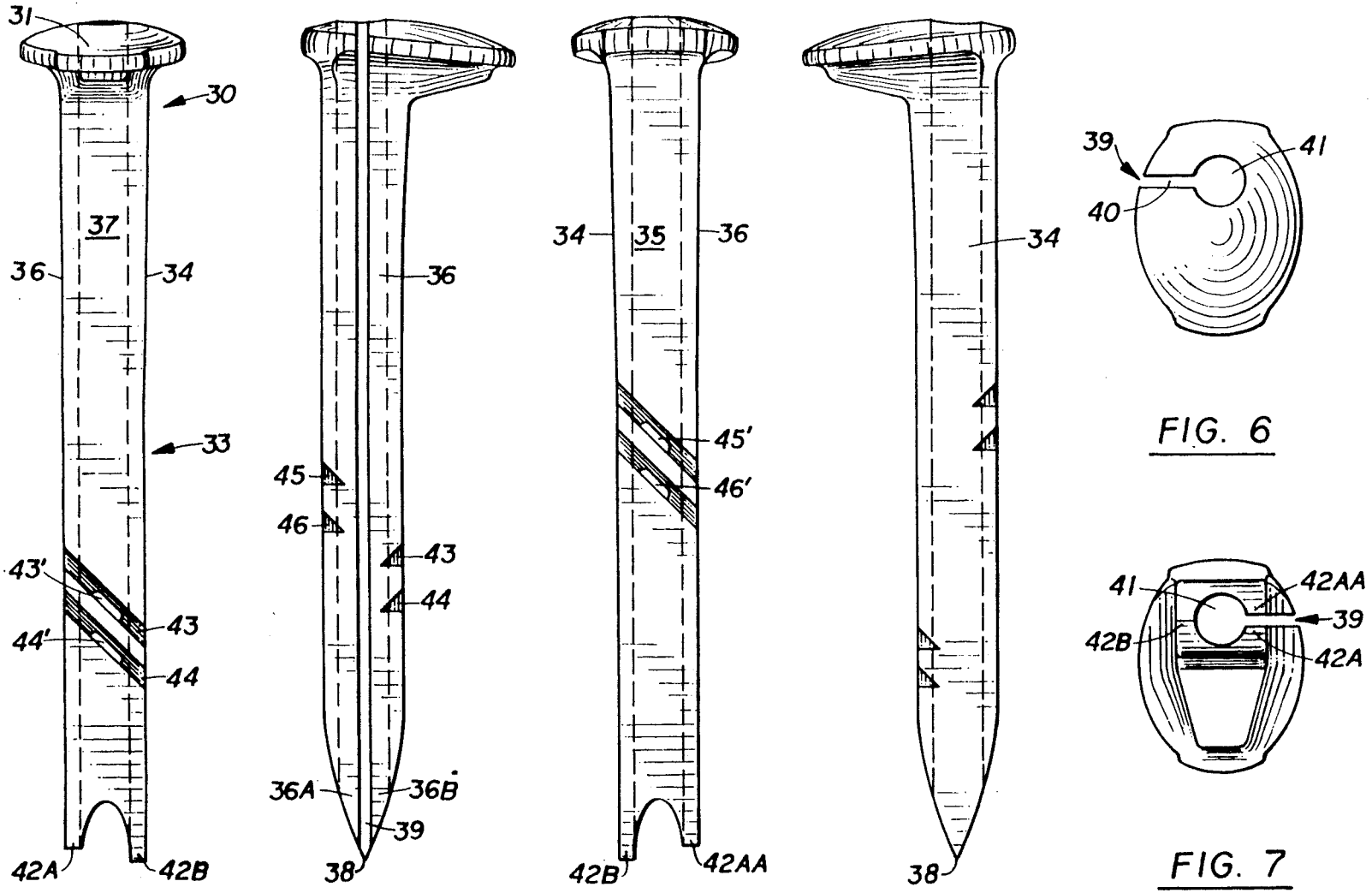
FIG. 2 is a rear elevational view of the spike of this invention.
FIG. 3 is a left side elevational view of the spike of this invention.
FIG. 4 is a front elevational view thereof.
FIG. 5 is a right elevational view thereof.
FIG. 6 is a top plan view of the improved railroad spike of this invention.
FIG. 7 is a bottom plan view thereof.

A keyslot bore 39 seen best in FIG. 6 having an elongated slot 40 extending inwardly from one side, such as side 34, as shown here communicates with a circular bore 41 down the full length of shank 33. Typically bore 41 is about 0.4375 (7/16) inches in diameter and greater than the width of the elongated slot. Since bore 41 does extend to and through the tip or pointed edge 38 a pair of pointed segments 42A, 42B are created. See FIG. 7. However, since slot 39 extends full length, two segments spaced on opposite sides of the slot are created. Thus the need for the designator 42AA as seen in FIG. 7.

Two pairs of closely spaced oppositely slanted V-grooves, one pair above the other, extend across the shank 33, one pair each on the front side 35, and the rear side 37 of the device. See FIGS. 2, 3, and 4. The depth of these V-grooves 43, 44, 45 and 46 is such that they all communicate with the bore 41 for reasons to be discussed below. The four openings to bore 41 are designated 43', 44', 45' and 46'. Again, the purpose for this communication to the bore 41 will be provided below. The recommended angle for the two pairs of V-grooves is about 45 degrees relative to the vertical. Other angles as low as 30 degrees and as high as 90 degrees i.e., normal to bore 41, are acceptable however.

Two sets of V-grooves with the lower disposed ones on the right face was done specifically to help ensure that on driving of the spike, the shearing action would cause the tip of the spike to curve or move forwardly. The primary grab effect is by the front surface's grooves with the secondary grabbing being done by the rear surface's grooves.

Reference to FIG. 6 shows that the keyslot bore 39 is facing leftwardly. Mirror-image units with the keyhole facing rightwardly are also contemplated and would give similar results. See FIG. 8 to support this position.

It is also within the scope of the invention to prepare units having only the front face V-grooves as these provide the main shearing action. When two sets of V-grooves are employed, it is preferred that they be oppositely directed, i.e. one goes upper left to lower right and the other upper right to lower left.

INSERTION AND OPERATION OF THE DEVICE

Figure 8:
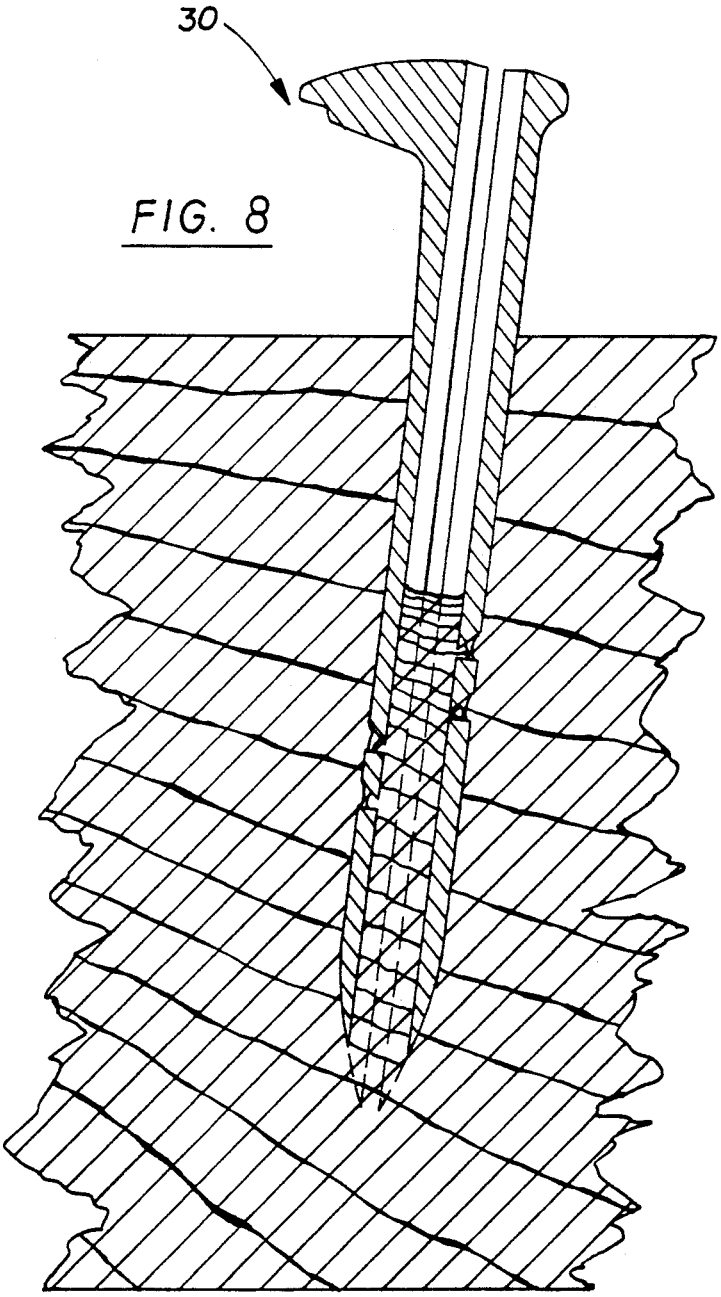
FIG. 8 is a sectional view showing the spike of this invention inserted into a simulated railroad tie.

FIG. 8 depicts a cutaway view of a simulated railway tie with the spike of this invention driven into it. Since their presence is not necessary for an understanding of the invention, the tie plate and the rail itself have been omitted. Their presence is not necessary for an understanding of the invention since the tie plate merely provides a locus for the driving of the spike. That is, the spike is driven through an opening in the metal tie which opening is larger than the spike such that no resistance is met during the driving procedure. The rail itself is merely held beneath the offset head. The position of the spike within the pseudo-rail is such as to allow for the presence of a rail if one were to be present.

The spike 30 of this invention which is sized and configured to match that of a conventional U.S. railroad spike, is driven in to its customary depth using any known prior art method in use by the railroads today. This ranges from everything from a sledge hammer to a totally automated track laying and repair machine. This is possible because the spike of this invention is dimensionally similar to a conventional spike. Whereas when the conventional spike 10 is driven, a bulk condition is created, in that the spike displaces a certain amount of wood and that wood has no place to go, so it oftentimes splits instead of merely being compressed. However, with the spike 30 of this invention, the wood that is displaced by the pointed edge entering the tie forms a core 47 and it takes the easiest path of going up into the keyslot 39's bore 41. In addition the two sections 36A and 36B of side 36 as seen in FIG. 3 are drawn toward each other, in a motion I believe that has the rear face 37 moving forwardly at the bottom and distorting. See FIG. 8. The effect is similar to that of a roll pin locking in. Once the spike is driven in, one takes a drift punch or a pilot punch, both of which are common tools, and which are not shown in the figures, and pokes the punch down into the bore 41 several times to impact upon the wood core 47. This has the effect of compacting the wood core 47 to lock the spike 30 in place. This compaction forces core wood into the V-groove openings 43'–46' from the inside of the spike toward the outside. Again see FIG. 8. The core may be compacted in some instances as much as an inch or even more by the punch. Again this is a taking of the path of least resistance. The downward force of the punch pushes the core wood 47 someplace. It is easier to move into the aforementioned groove openings than to be fully compacted so a part of the wood goes into the grooves and thereby locks the spike into position.

Splitting of ties and the loosening of spikes often arises due to a drying of the wood of the tie. Rain may hit the outside, but not permeate down into the interior of the tie. Because the spike 30 of this invention is open at the top, rain water can seep in to reach the interior of the tie. This moisture inside keeps the interior of the wood from splitting at future times. The core wood 47 absorbs moisture and expands to apply pressure internally to spike 30.

The spikes of this invention will be made by a forging process. After the hot forge unit is prepared, a mandrel having a fin with a blade thereon would impact the red-hot forging and draw out the keyslot 39 similar to a wire drawing procedure. The V-grooves will be added by a broaching procedure. Another mode of manufacturing the device of this invention is by the use of an upset forging die.

Even though the insertion of the spikes of this invention is a two step process, the elapsed time to do so will be less than for conventional spike application. Somewhere I believe on the order of 25 to 50% less time due to the removal of a significant portion of the friction encountered during the driving process, if insertion is carried out by an automated tool.

It is also within the scope of this invention to dip or otherwise apply to, at least a portion of the shank from the pointed tip upwardly, a coating of soap or Teflon ® to ease insertion.

Since certain changes may be made in the above device without departing from the scope of the invention herein involved, it is intended that all matter contained in the above description and shown in the accompanying drawings shall be interpreted as illustrative and not in a limiting sense.

I claim:

1. An improved railroad spike configured and sized to match conventional U.S. railroad spikes, which improved spike includes an offset head at one end of an elongated generally square shank having front and rear surfaces and two side surfaces, the front and rear of which square shank taper to a pointed tip, the improvement comprising:

a full length keyhole bore extending through said head and said tip, said keyhole bore comprising an elongated slot and a bore of greater diameter, the slot of which extends inwardly from one side of said shank, and a spaced pair of angularly disposed V-grooves in communication with said bore, and disposed on the front and rear surface of said shank.

2. The improved railroad spike of claim 1 wherein the V-grooves are disposed at about a 45 degree angle relative to the vertical.

3. The spike of claim 1 further including a second pair of spaced V-grooves also in communication with said bore, and angularly disposed on the rear surface of said shank.

4. The spike of claim 3 wherein the two sets of V-grooves are disposed at about a 45 degree angle relative to the vertical.

5. The spike of claim 1 wherein the bore of the keyhole bore is about 0.4375 inches in diameter.

6. The spike of claim 4 wherein the two sets of V-grooves are oppositely directed.

7. The spike of claim 6 wherein the V-grooves of the front surface are disposed below the V-grooves of the rear surface.

8. An improved railroad spike configured and sized to match conventional U.S. railroad spikes, which improved spike includes an offset head at one end of an elongated generally square shank having front and rear surfaces and two side surfaces, the front and rear of which square shank taper to a pointed tip, the improvement comprising:

a full length keyhole bore extending through said head and said tip, said keyhole bore comprising an elongated slot and a bore of greater diameter, the slot of which extends inwardly from one side of said shank;

a first spaced pair of angularly disposed V-grooves in communication with said bore, disposed on the front surface of said shank;

a second pair of angularly disposed V-grooves in communication with said bore, disposed on the rear surface of said shank;

wherein the first pair of said V-grooves is disposed below said second pair of V-grooves.

9. The railroad spike of claim 8 wherein the two pairs of V-grooves are oppositely directed.

* * * * *